US006848766B2

(12) United States Patent
Garbacz et al.

(10) Patent No.: US 6,848,766 B2
(45) Date of Patent: Feb. 1, 2005

(54) START-UP AND SHUT DOWN OF CONTINUOUS INKJET PRINT HEAD

(75) Inventors: Gregory J. Garbacz, Rochester, NY (US); Charles F. Faisst, Jr., Avon, NY (US); John Sechrist, Rochester, NY (US); Joseph R. West, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 52 days.

(21) Appl. No.: 10/269,626

(22) Filed: Oct. 11, 2002

(65) Prior Publication Data

US 2004/0070645 A1 Apr. 15, 2004

(51) Int. Cl.[7] ..... B41J 2/165
(52) U.S. Cl. ..... 347/25; 347/34
(58) Field of Search ..... 347/22, 25, 28, 347/29, 30, 34

(56) References Cited

U.S. PATENT DOCUMENTS

| | | | | |
|---|---|---|---|---|
| 4,122,457 A | | 10/1978 | Erikson et al. | |
| 4,190,844 A | | 2/1980 | Taylor | |
| 4,520,366 A | | 5/1985 | Cragin, Jr. | |
| 4,591,869 A | | 5/1986 | Katerberg et al. | |
| 4,837,585 A | | 6/1989 | Williams et al. | |
| 4,914,522 A | | 4/1990 | Duffield et al. | |
| 4,970,535 A | * | 11/1990 | Oswald et al. | 347/25 |
| 5,877,788 A | * | 3/1999 | Haan et al. | 347/28 |
| 6,079,821 A | | 6/2000 | Chwalek et al. | |
| 2002/0036670 A1 | | 3/2002 | Colombat | 347/28 |

FOREIGN PATENT DOCUMENTS

| | | | |
|---|---|---|---|
| EP | 1162071 | | 12/2001 |
| EP | 1277580 | | 1/2003 |
| JP | 4-39055 | * | 2/1992 |
| WO | WO 0236347 | | 5/2002 |

* cited by examiner

*Primary Examiner*—Shih-Wen Hsieh
(74) *Attorney, Agent, or Firm*—William R. Zimmerli

(57) ABSTRACT

A cleaning system for a continuous inkjet printer comprises a cleaning chamber positioned substantially parallel to an ink supply chamber and nozzle plate, and a gas supply, such as air or nitrogen. The cleaning chamber is formed by a cover and the nozzle plate, wherein the gas is routed between the cover and the nozzle plate so as to remove debris and excess ink from the inkjet nozzles and surrounding area. A fluid may also be applied in addition to the gas, and a deflector may be positioned on the cover to increase the angle of incidence of air and fluid as it contacts the inkjet nozzles and surrounding area.

29 Claims, 10 Drawing Sheets

START-UP AND SHUT DOWN OF CONTINUOUS INKJET PRINT HEAD

FIELD OF THE INVENTION

The present invention relates to inkjet printers, and more particularly to inkjet printers using a continuous ink stream type print head.

BACKGROUND OF THE INVENTION

Digitally controlled printing is typically accomplished using one of two technologies referred to as "drop-on-demand" and "continuous" inkjet printing. Both printing techniques utilize ink supplies for each color of ink, with the ink being ejected through nozzles formed in a print head.

Drop-on-demand inkjet printing typically uses a thermal or mechanical actuator to provide ink droplets for deposition on a print medium. In continuous ink jet printing technology, ink is typically supplied to an ink reservoir in a print head under pressure so as to produce a jet, or continuous stream of ink from a nozzle in liquid communication with the reservoir. Periodic excitations are imposed on the ink stream to cause the stream to break up into ink droplets.

Some continuous inkjet printers utilize air flow to control the trajectory of ink droplets ejected from a print head, wherein ink droplets can be deflected from their ejection path as they leave the print head to either a print medium or an ink capturing mechanism such as a catcher or gutter. The ink captured by the capturing mechanism can either be recycled back to the ink reservoir for reuse, or disposed of.

Difficulties are often experienced during start-up of continuous stream ink jet printers, when the print head is in an initial dry nozzle plate condition. The ink driving pressure increases from zero but is initially too low to overcome surface tension and drive the ink out of the tiny nozzles in the nozzle plate. A transition period is then reached in which the ink driving pressure overcomes the surface tension effects to force some ink through the nozzles, but the pressure is still insufficient to produce well formed fluid jets of ink. During this transition period from the initial dry nozzle plate condition to fluid jets of ink, ink typically leaks from the print head nozzle and creates a fluid film or beads on the nozzle plate. A similar phenomenon occurs when the printer or print heads are shut down, after which the fluid film or beads can dry on the nozzle plate prior to the next start-up or printing operation of the print head.

A fluid film formed at the nozzle plate increases the probability that fluid leaving the nozzle plate will never overcome the surface tension of the film formed at the nozzles. Fluid beads on the nozzle plate can cause nozzles under the beads to produce a continuous flow of ink that adheres to the nozzle plate. In addition, beads formed adjacent to nozzles can cause misdirection in ink ejected from such nozzles, and inconsistencies in droplet size and shape. The most common solution to clogged jets is to flush the nozzle, or plurality of nozzles with a large amount of ink, however such a method wastes the ink and is not always effective. In addition, this method may not remove the fluid beads from locations adjacent the nozzles, thus misdirected and misshapen drops continue to be ejected from the print head and produce poor quality print images.

SUMMARY OF THE INVENTION

A print system according to one aspect of the invention comprises a print head, configured to output a stream of ink from a plurality of nozzles, a cleaning chamber substantially around an ink ejection area of the plurality of nozzles, wherein the cleaning chamber has an outlet for the stream of ink, and a pressurized gas source coupled to the cleaning chamber, whereby the gas is routable through the cleaning chamber at a flow rate sufficient to remove debris and excess ink from a region of the print head.

The print system may further comprise a deflector, positioned on a wall of the chamber so as to deflect the gas to increase an angle of incidence at which gas flow is directed at the plurality of nozzles. An additional aspect of the invention comprises a fluid source coupled to the cleaning chamber, and a deflector positioned on the wall and configured to deflect the fluid so as to effectively cover an area of the plurality of nozzles, wherein the air routed through the cleaning chamber also removes the fluid.

The gas can be air or nitrogen, for example, and the print system may further comprise a negative pressure source coupled to one end of the cleaning chamber.

Another aspect of the of the invention comprises a method of removing unwanted particles from one or more print head nozzles, wherein the method comprises forcing a blast of air into a chamber substantially surrounding the nozzle at a flow rate sufficient to remove unwanted particles from the print head nozzle. The method may further comprise deflecting the gas in the chamber so as to increase an angle of incidence at which the air is directed at the nozzle.

An additional aspect to the method may comprise routing a fluid through the chamber so as to change surface properties of the unwanted particles, and deflecting the fluid in the chamber so as to effectively cover a substantial area of the nozzle for removal of unwanted particles.

Yet another aspect of the invention comprises a system for removing unwanted particles from one or more print head nozzles, comprising means for forcing a blast of gas at the print head nozzle and a surrounding area. The system may further comprise means for increasing an angle of incidence at which the gas is directed at the nozzle, and means for applying a fluid to the nozzle and a surrounding area. The system may further comprise means for deflecting the fluid so as to effectively cover a substantial area of the nozzle for removal of unwanted particles. The fluid may be, for example, alcohol.

Another aspect of the invention comprises a printing system, comprising a print head, configured to produce a stream of ink from a plurality of nozzles, a first flow path positioned proximate to an ink ejection area of the plurality of nozzles, wherein gas is routed through the first flow path at a flow rate sufficient to remove debris and excess ink from the plurality of nozzles and a surrounding area, and a second flow path positioned farther away from the ink ejection area of the plurality of nozzles than the first gas flow path, configured to provide a path for gas flow for deflecting at least portions of the stream of ink.

The first flow path may include a deflector configured to increase an angle of incidence at which the gas contacts the plurality of nozzles and surrounding area. The fluid may be routed through the first flow path in addition to the gas.

DETAILED DESCRIPTION OF THE INVENTION

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Certain embodiments of the invention comprise a method and apparatus for removing debris and excess ink from an ink ejection area of an inkjet print head employing continuous ink jets. In one embodiment of the invention, a burst of gas is routed through a chamber which is proximate to an area of a print head nozzle plate from which ink is ejected. The gas burst advantageously removes debris and unwanted ink from the ejection point nozzle of an ink jet, such that the jet, and the ink droplets produced by the jet, maintain a desired trajectory, shape, and size. In some embodiments, a cover plate is placed over the nozzle location in the print head so as to create a chamber for gas flow.

In an additional embodiment, a fluid is routed through the chamber in addition to the gas, so as to change surface properties of unwanted debris and excess ink located at the nozzle plate, such that the debris and ink are removed more easily and effectively by the flow or burst of gas through the chamber. The use of gas and fluid flow into the chamber can advantageously be applied at startup and/or shut down of the print head so as to remove debris and excess ink collected on the print head during start-up and shut down of the print heads in an inkjet printer. The application of gas and/or fluid may also occur during operation of the print heads, such as between passes of the print head along a print medium.

Figure 1:
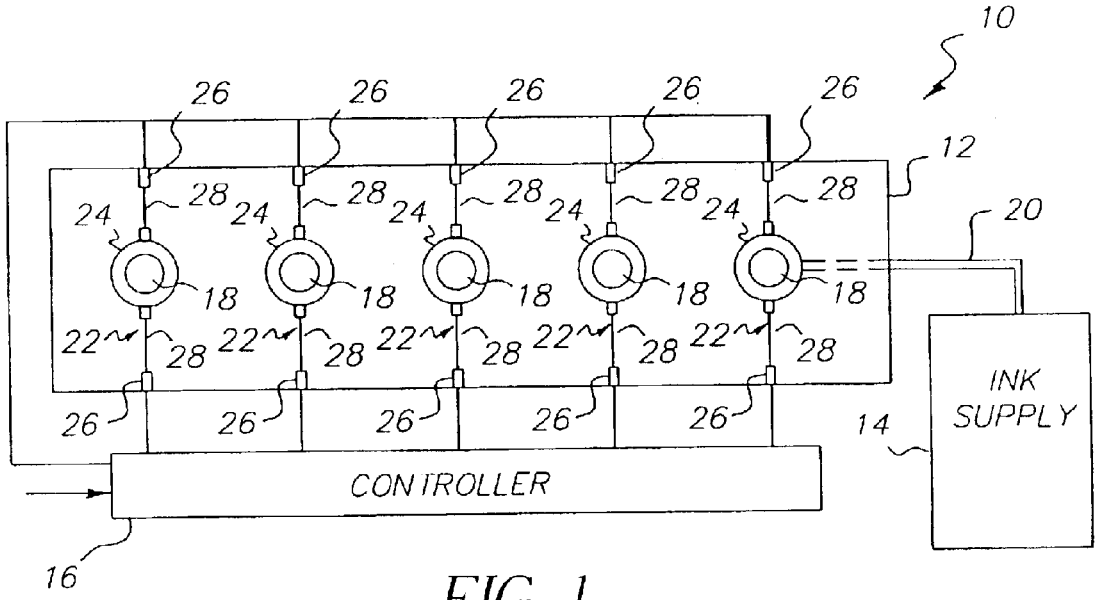
FIG. 1 is an illustration of one embodiment of a printing system.

An exemplary printing system 10 is illustrated in FIG. 1, wherein the printing system 10 can be implemented in a printer along with systems and methods described further herein.

The printing system 10 comprises a print head 12, at least one ink supply 14, and a controller 16. The print head 12 can be formed from a semiconductor material, such as silicon, using fabrication techniques well known in the field. A plurality of nozzles 18 can be formed on the print head 12, wherein the nozzles 18 are in fluid communication with the ink supply 14 through an ink passage 20, also formed in the print head 12.

In the embodiment of FIG. 1, a heater 22 is positioned or formed on the print head 12 at each nozzle 18 so as to facilitate the ejection of ink filaments from the nozzle 18 and break-up of the filaments into droplets. In the present embodiment, the heater 22 is implemented with a resistive heat element 24 coupled to electrical contact pads 26 via conductors 28. The contact pads 26 can be coupled to the controller 16 such that the controller 16 controls activation of the resistive heat element 24, thus controlling the production of the stream of ink droplets produced by the nozzles 18.

Figure 2:
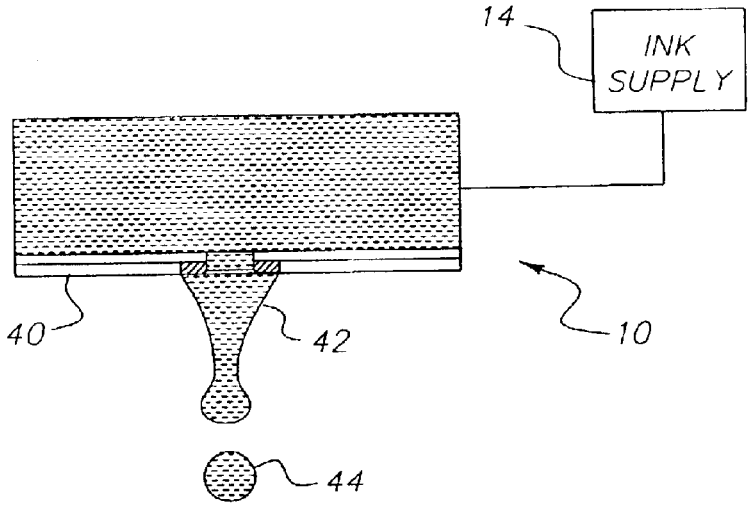
FIG. 2 is a cross-sectional view of the printing system of FIG. 1.

FIG. 2 is a cross-section of the print head 12 shown in FIG. 1, illustrating the expulsion of ink from the nozzle 18. As can be seen in FIG. 2, the print head 12 comprises a nozzle plate 40 having a plurality of nozzles, through which ink leaves the print head 12. During operation, ink from the ink supply 14 is ejected through the nozzle in the nozzle plate 40 of the print head 12 to create a filament 42 of ink. The resistive element 24 can be activated to break up the filament 42 into a stream of individual ink droplets 44 for deposition on a print medium. The area around the nozzles in the nozzle plate 40 are the primary areas where excess ink and debris form, which adversely affect the performance of the printer.

It will be appreciated that the printing system 10 as shown and described in reference to FIGS. 1 and 2 is exemplary in nature, and the invention is not limited to such a print system.

Figure 3:
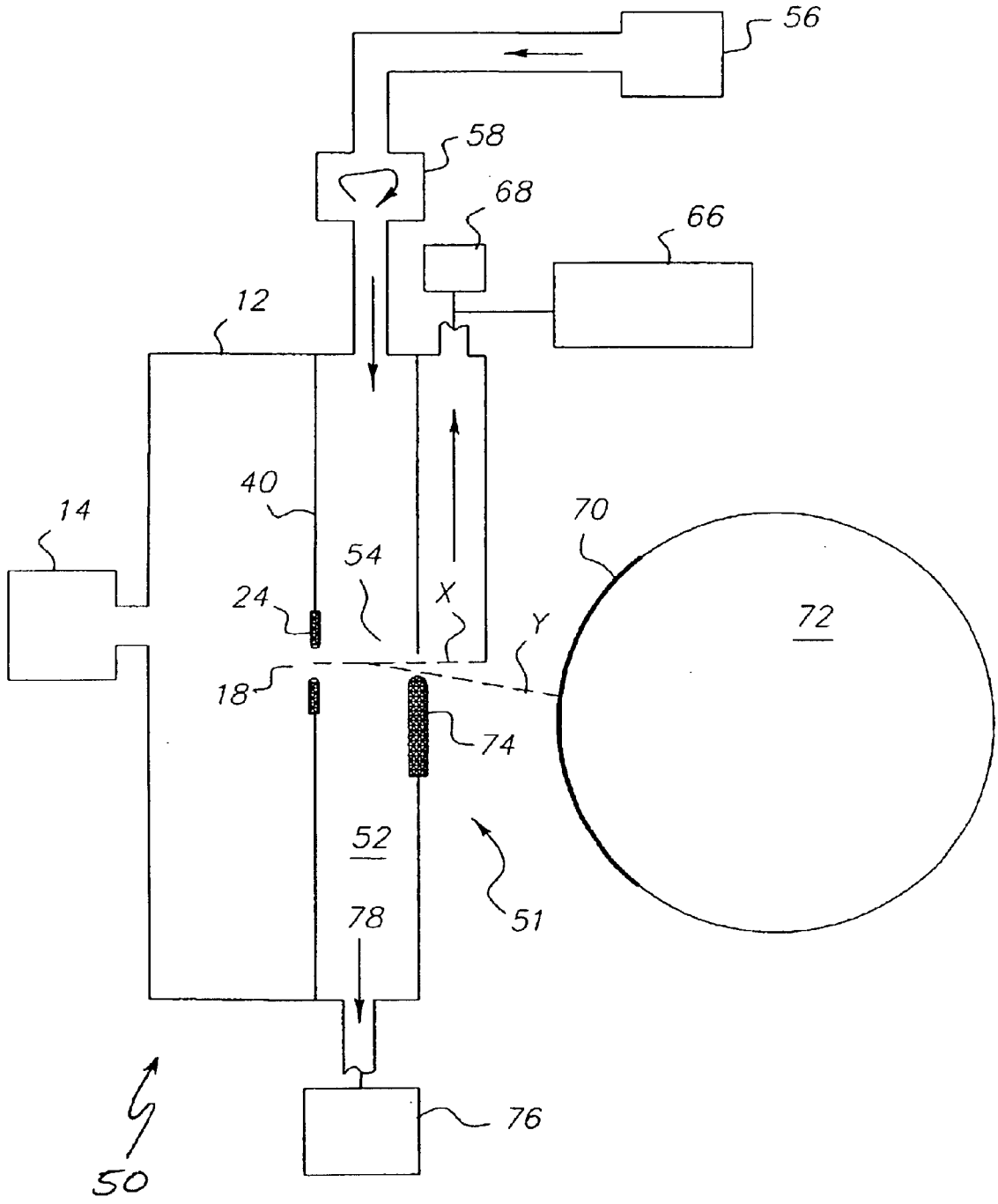
FIG. 3 is a cross-sectional side view of one embodiment of a printer implementing the printing system of FIGS. 1–2.

The printing system 10 can be implemented in the printer 50 illustrated in FIG. 3. The printer 50 employs a droplet deflector system 51 comprising a gas flow chamber 52 (or substantially contained gas flow path) positioned near the nozzle plate 40 such that ink ejected from the nozzle 18 travels through the gas flow chamber 52 and out an opening 54 substantially aligned with the nozzle 18. Gas flow is provided by a gas source 56 and regulated by a gas flow regulator 58 prior to entry into the gas flow chamber 52.

A stream of large volume ink droplets and small volume ink droplets, formed from the ink filament 42, can be ejected from the nozzle 18 substantially along a path X. In the droplet deflector system 51, gas flow can be provided to the gas flow chamber 52 to apply a force to the stream of ink droplets ejected from the nozzle 18, such that the small volume ink droplets diverge from path X along a printing path Y. The large volume ink droplets may continue along path X and into a gutter 60, which routes the ink from the large volume ink droplets to, for example, an ink recovery system 66. A negative pressure source 68 can provide a negative pressure to the gutter 60 so as to assist in the separation of the small ink droplets from the large ink droplets, and the recovery of the ink droplets traveling substantially along path X.

The printing path Y leads the small ink droplets to a print medium 70 supported on a print drum 72, and a catcher 74 is positioned at or near the opening 54 such that ink droplets straying from the printing path Y are prevented from contacting the print medium 70. An additional negative pressure source 76 can be provided at an outlet 78 of the gas flow chamber 52 so as to apply a negative pressure to the gas flow chamber and assist in the separation of the small ink droplets and the large ink droplets. Also, the negative pressure source 76 can assist in the removal of ink, collected at the catcher 74, from the gas flow chamber 52. The outlet 78 of the gas flow chamber 52 may also have fluid communication with the ink recovery system 66.

Figure 4:
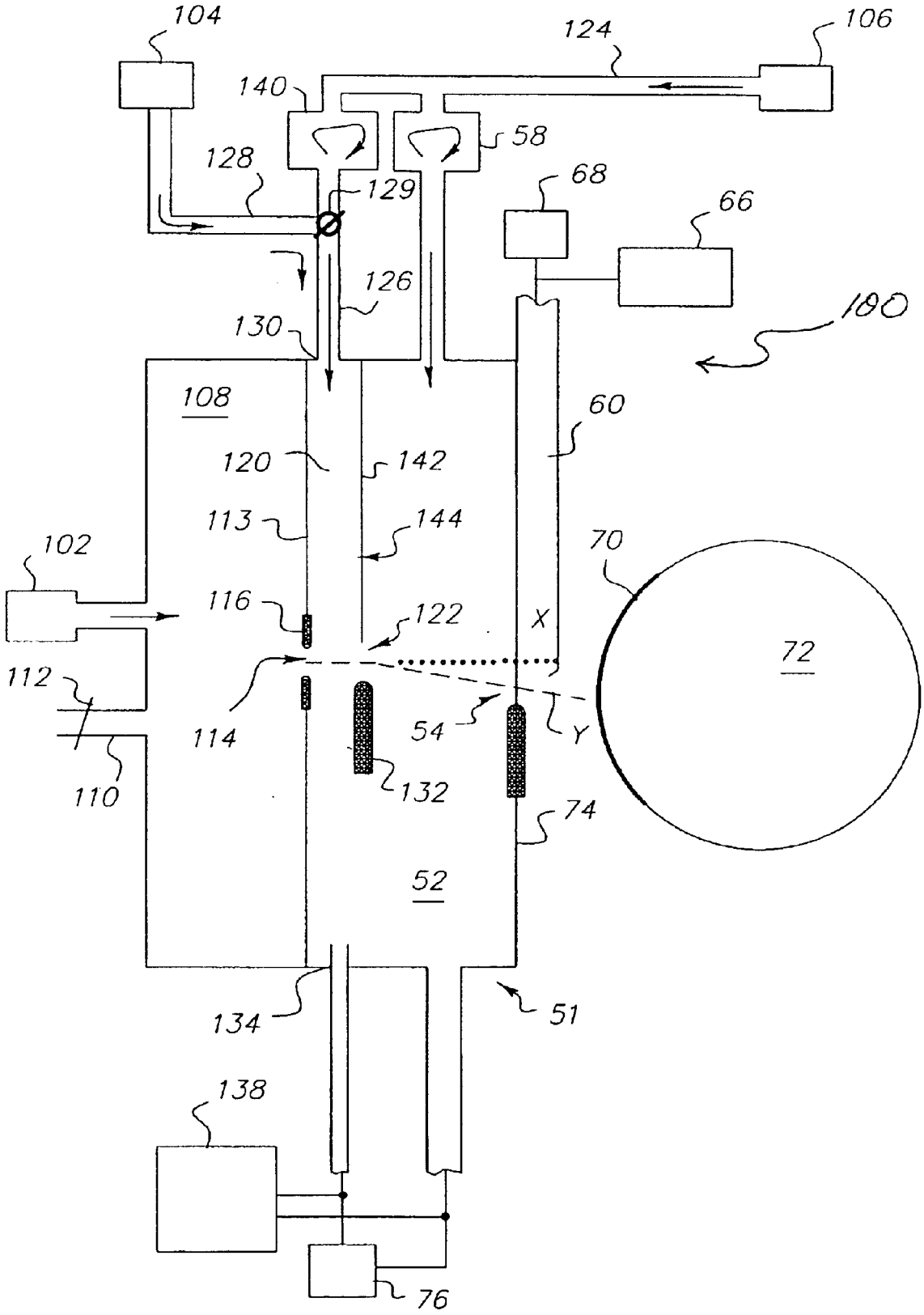
FIG. 4 is a cross-sectional side view of one embodiment of a printing system.

FIG. 4 illustrates a cross-sectional view of one embodiment of a print head cleaning system 100, which can be implemented in the printer 50 in combination with the droplet deflector system 51. This embodiment comprises an ink supply 102, a fluid supply 104, and a gas supply 106. The ink supply 102 provides ink to an ink supply chamber 108, which can have an outlet 110 with a valve 112 so as to control back-pressure in the ink supply chamber 108. The fluid in the fluid supply 104 can be, for example, isopropyl alcohol, or any other fluid which will change the surface tension and/or other characteristics of ink to be removed from the print head. The ink supply chamber 108 comprises a nozzle plate 113 with an opening 114 through which ink is ejected from the ink supply chamber 108 and controlled by operation of a heating element 116 located proximal to the opening 114.

In the embodiment of FIG. 4, a cleaning chamber 120 is located parallel to the ink supply chamber 108 such that the ink ejected from the opening 114 travels through the cleaning chamber 120 and out a slit 122 in the cleaning chamber 120, wherein the slit 122 is substantially aligned with the opening 114 in the nozzle plate 113. A gas is routed to the cleaning chamber 120 from the gas supply 106 via delivery channels 124 and 126, and fluid can also by routed to the cleaning chamber 120 from the fluid supply 104 via delivery channels 128 and 126. A control valve 129 can be positioned at a location where delivery channels 126 and 128 intersect, so as to control whether gas, fluid, or gas and fluid are allowed to enter the cleaning chamber 120. The gas supply 106 can be an air supply or nitrogen supply, for example. In other embodiments, a negative pressure supply can be used such that negative pressure (relative to atmospheric pressure) is applied to the cleaning chamber 120 rather than positive pressure gas flow from the gas supply 106. In this embodiment, the gas supply 106 also provides the gas flow for the gas flow chamber 52.

As shown in FIG. 4, the gas, fluid, or gas/fluid mixture enters the cleaning chamber 120 through an inlet 130 in a flow direction substantially perpendicular to a direction in which ink is ejected from the opening 114. The gas, fluid, or gas/fluid mixture is forced through the cleaning chamber at a rate sufficient to remove debris and excess ink from the nozzles and the area surrounding the nozzles. Thus, as gas or fluid (or a combination) flows into the cleaning chamber 120 through the inlet 130, it clears debris and excessive ink from the opening 114 and surrounding area. In many advantageous embodiments, the gas and/or fluid flow through the cleaning chamber is maintained for at least the duration of the above described "transition period" during start-up and/or shut down of the ink jets when fluid and debris has a tendency to collect around the nozzles. As also described above, however, the gas flow may be forced through the cleaning chamber 120 at appropriate times during normal operation if desired.

The debris and excessive ink cleared by the gas flow can be deflected to a catcher 132 located on an edge of the slit 122 opposite the inlet 130, or it can flow out of the cleaning chamber 120, along with the gas, through an outlet 134 located at an end of the cleaning chamber 120 opposite the inlet 130. The catcher 132 can be, for example, a porous frit or foam material, a mesh screen, or a gutter so as to prevent fluid, debris, excessive ink, etc., from leaving the cleaning chamber 120 via the slit 122. The outlet 134 from the cleaning chamber 120 can be in fluid communication with an additional ink recovery system 138 along with the outlet 78 from the gas flow chamber 52, so as to route ink, gas, and fluid to a recovery or recycling system.

In the event fluid is also routed into the cleaning chamber 120 from the fluid supply 104, it can also exit the cleaning chamber 120 via the outlet 134. In one embodiment, the outlet 134 can also have communication with the negative pressure source 76 in addition to the outlet 78, so as to increase the force and rate with which debris and excess ink can be removed from the cleaning chamber 120. Also, a gas flow valve 140 can be positioned in the flow path 124 between the gas supply 106 and the cleaning chamber 120 so as to control the amount and pressure of gas flow into the cleaning chamber 120.

In one embodiment, the cleaning chamber 120 is formed by the nozzle plate 113 and a cover 142, wherein the cover 142 is positioned substantially parallel to the nozzle plate 113. In one advantageous embodiment, the cover 142 also comprises a deflector 144 located on the gas inlet 130 side of the slit 122, such that gas or fluid entering the cleaning chamber 120 is deflected by the deflector 144 to the nozzle opening 114 at an increased angle of incidence. It will be appreciated by those skilled in the art that the placement of the deflector 144 in FIG. 4 is exemplary in nature and the print system is not limited to such a location, orientation, or structure. It will also be appreciated that the cover 142 may have an internal contour or shape so as to perform the fluid and air deflection function. It will also be appreciated that the cover may comprise a plurality of pieces rather than a unitary body, as shown and described in FIG. 4.

As described and shown herein, the gas flow chamber 52 of the drop deflector system 51 is positioned adjacent to the cleaning chamber 120, however the invention is not limited to such a structure. In one embodiment, the gas flow chamber 52 is more particularly a substantially contained gas flow path positioned approximately parallel to the cleaning chamber 120, such that a stream of ink leaving the cleaning chamber passes through a gas flow path of the drop deflector system 51. In addition, the droplet deflector system 51 can be implemented in a number of configurations in combination with the cleaning chamber 120 so as to effectively direct the appropriate ink droplets to the print media 70 in a desirable manner.

Figure 5B:
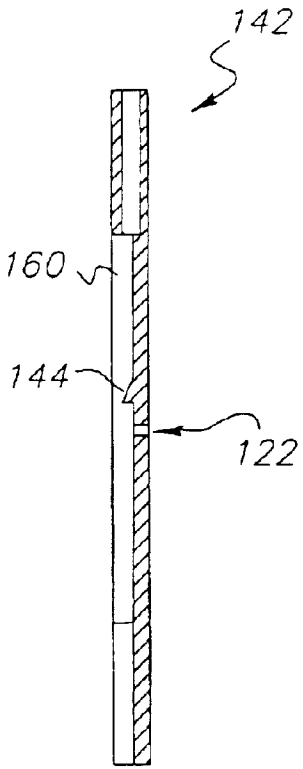
FIG. 5B is a cross-sectional view of the cover shown in FIG. 5A, as taken along line A—A.
Figure 5A:
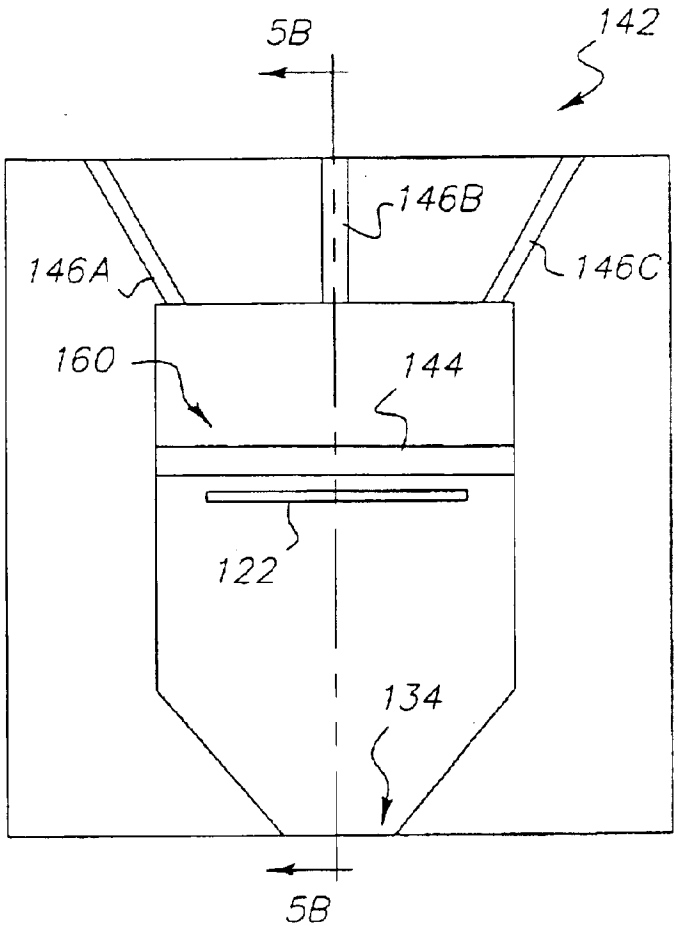
FIG. 5A is a layout view of one embodiment of a cover for the printing system of FIG. 4.

FIG. 5A is an illustration of one embodiment of a cover 142 which has been found suitable for use with the system of FIG. 4. FIG. 5B is a cross-sectional view of the cover 142 as taken along the plane A—A of FIG. 5A. The cover 142 illustrated in FIG. 5A comprises three inlets 146A–C for gas and/or fluid, the deflector 144, and the slit 122. The inlets 146A–C lead to a well or recessed area 160 on the inner surface of the cover 142, as illustrated more clearly in FIG. 5B. When the cover 142 is positioned against the ink supply chamber 108, the well 160, in combination with the nozzle plate 113, forms the cleaning chamber 120. In one advantageous embodiment, as illustrated in FIGS. 4–8, the deflector 144 has a bevel extending at least along a length of the slit 122, and parallel to the slit 122. The bevel can be designed with different angles so as to effectively direct the fluid and gas through the cleaning chamber 120 and toward the nozzle plate of the print head.

Figure 5C:
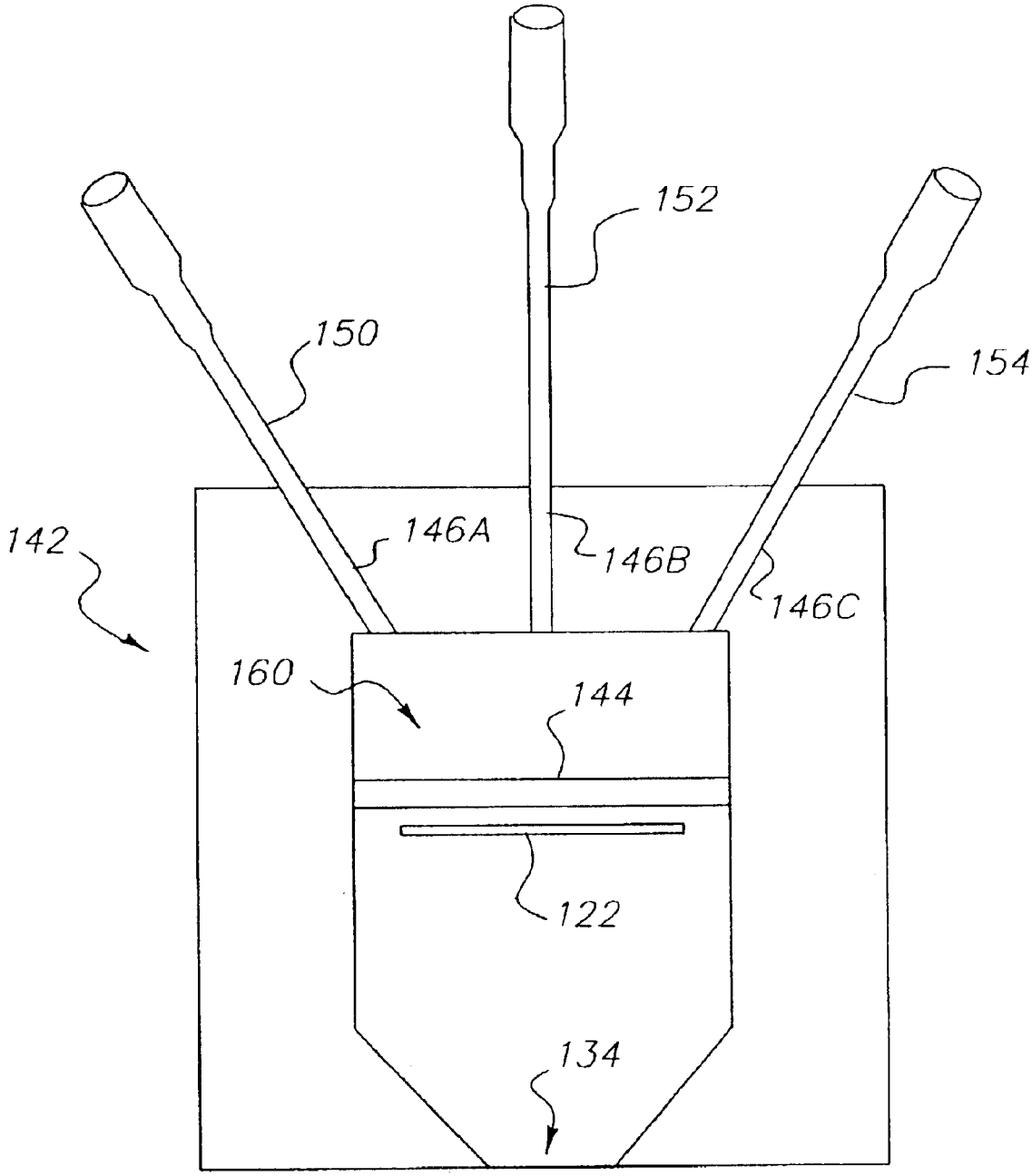
FIG. 5C illustrates one embodiment of a cover and an air/fluid supply system.

FIG. 5C illustrates one advantageous embodiment for the supply of fluid and gas to the cleaning chamber 120. The supply system illustrated in FIG. 5C comprises a first gas supply needle 150 configured to supply gas flow via inlet 146A, a liquid supply needle 152 configured to supply liquid via inlet 146B, and a second gas supply needle 154 configured to supply gas flow via inlet 146C. The supply needles 150–154 can be, for example, EFD needles, and the gas supplied through the gas supply needles 150, 154, can be, for example, nitrogen, or air.

A method of operation of one embodiment of the print head cleaning system will now be described with reference to FIGS. 6–7, wherein FIGS. 6–7 illustrate only a portion of a print head cleaning system for clarity of discussion.

Figure 6B:
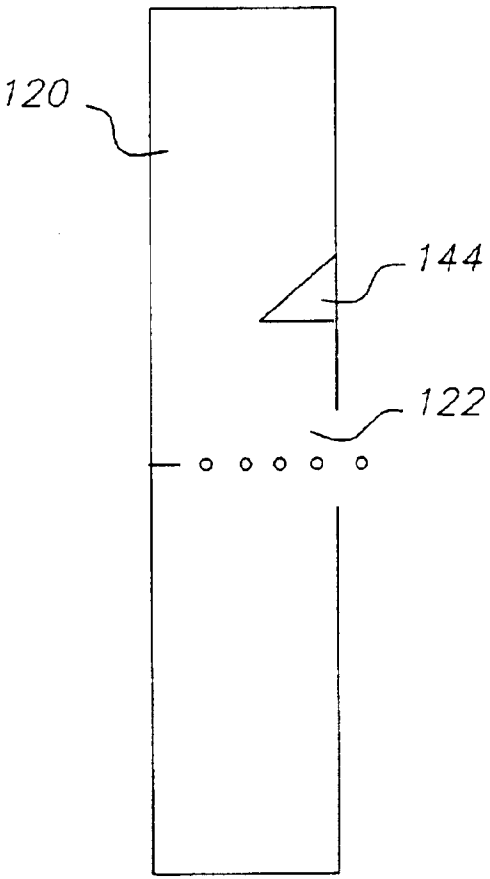
FIG. 6B is an illustration of one method of operation of the printing system of FIG. 1 with no air flowing through a cleaning chamber.
Figure 6A:
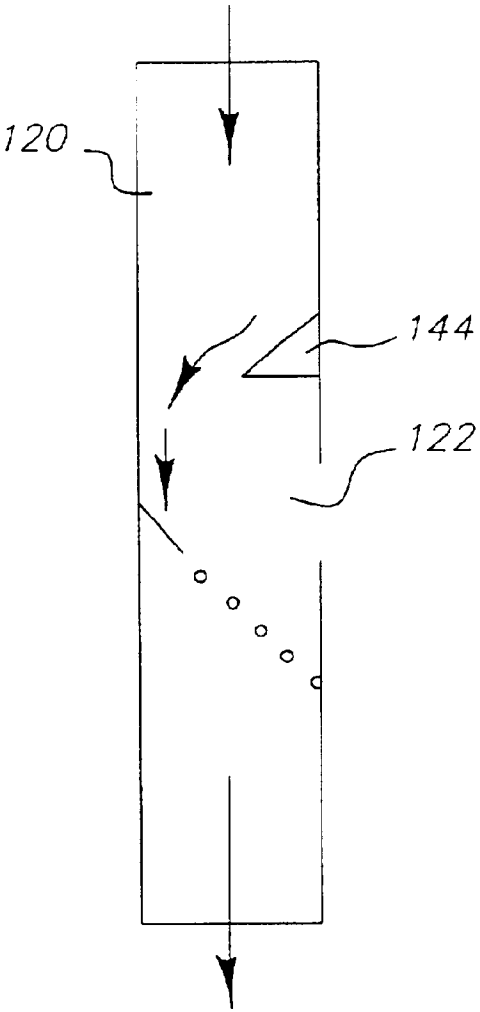
FIG. 6A is an illustration of one method of operation of the printing system of FIG. 4 with air flowing through a cleaning chamber.

FIGS. 6A–B illustrate an air only case of operation wherein the print head is on and ink is being ejected from the nozzle plate 113. In FIG. 6A, a short blast of air is routed to the cleaning chamber 120 where it deflects off of a beveled edge of the deflector 144 to the ink outlet 114. The force of the air can remove much or all of the excess ink or debris located around the opening in the nozzle plate 113, wherein excess ink or debris could lead to undesired drop size or direction. The ink ejected from the nozzle plate, along with any ink removed from an area surrounding the opening 114 in the nozzle plate 113, is deflected past the slit 122 and out of the cleaning chamber 120. A vacuum can also be used at the outlet of the cleaning chamber 120 so as to supply a negative pressure to more effectively remove the deflected ink, excess ink, and debris from the cleaning chamber 120.

FIG. 6B illustrates the operation of the print head system without the presence of gas or fluid flow through the cleaning chamber 120, following the operation described with reference to FIG. 6A. During normal printing operations, therefore, the ink ejected from the print head nozzle is routed substantially straight through the slit 122 in the cover 142.

Figures 7A, 7B, 7C, 7D:
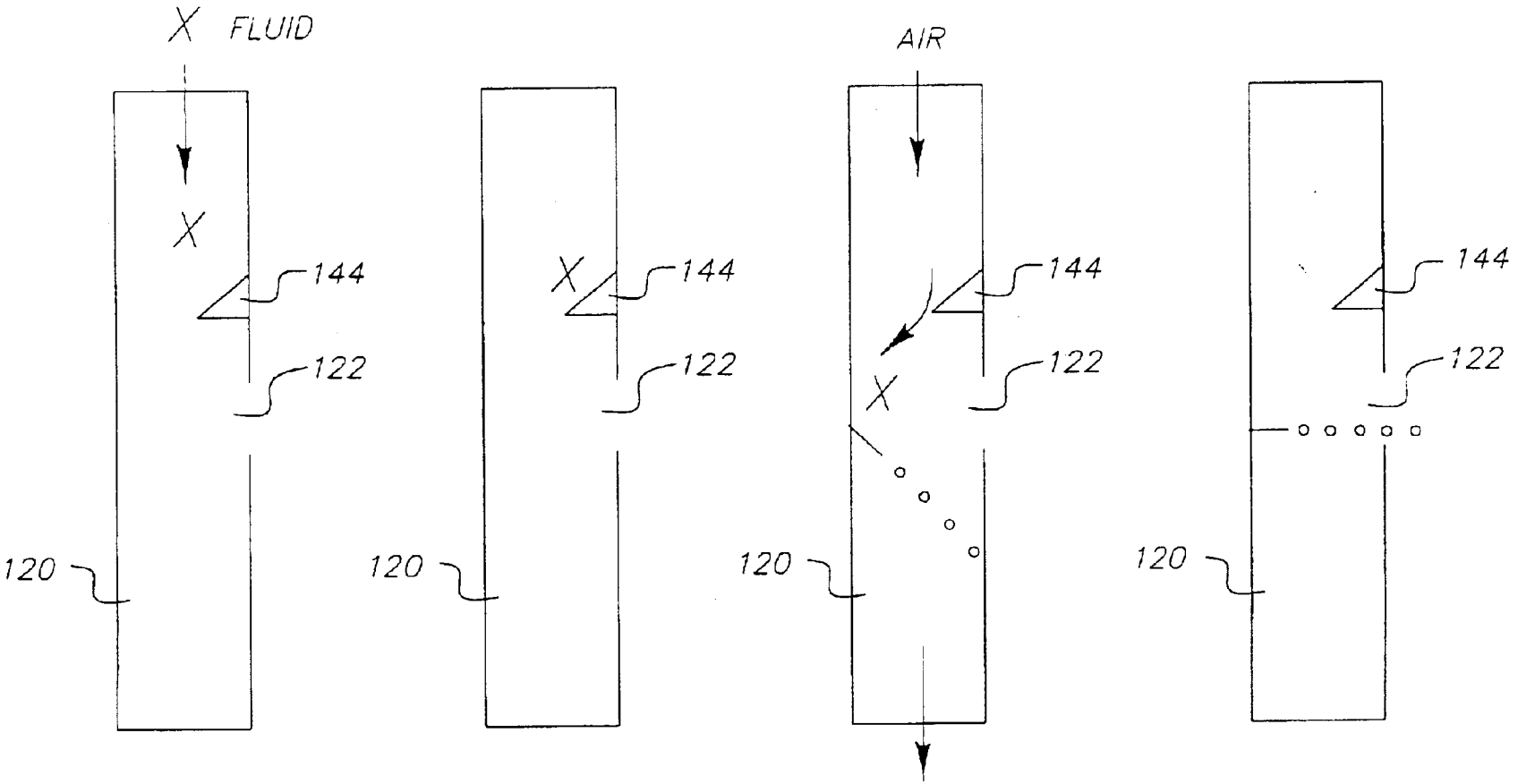
FIG. 7A illustrates the cleaning chamber with fluid entering the chamber.
FIG. 7B illustrates the cleaning chamber with fluid in the chamber and wicked on a deflector.
FIG. 7C illustrates the cleaning chamber with air flowing into the chamber and with the print head nozzles ejecting ink.
FIG. 7D illustrates the cleaning chamber with the print head ejecting ink and no air or fluid flowing into the chamber.

FIGS. 7A–D illustrate an air and liquid case of operation for the print head cleaning system. In FIG. 7A, the print head is off and no ink is being ejected from the print head nozzle. Fluid is routed into the cleaning chamber 120 where it wets along the bevel of the deflector 144, as shown in FIG. 7B. Following the fluid application, one or more air blasts can be applied to the cleaning chamber 120 to distribute the liquid toward the surface of the print head nozzle. Thus, the deflector allows the liquid to be sufficiently distributed to cover the significant area around the print head nozzles on the jet plate. One or more air blasts can be applied to the cleaning chamber 120, with or without liquid, to remove any excess ink or debris from the area of the print head nozzles. In some embodiments, initial air blasts and liquid application can be performed prior to start-up without the print head nozzles ejecting ink. In one such embodiment, a final air only blast is then applied to effectively remove the undesired debris, excess ink, and any remaining fluid from the cleaning chamber 120 prior to start up of the print head nozzles, or with the print head nozzles in operation, as illustrated in FIG. 7C. FIG. 7D illustrates the operation of the print head following the application of fluid and air bursts, wherein the ink drops are directed through the slit 122.

Figure 8:
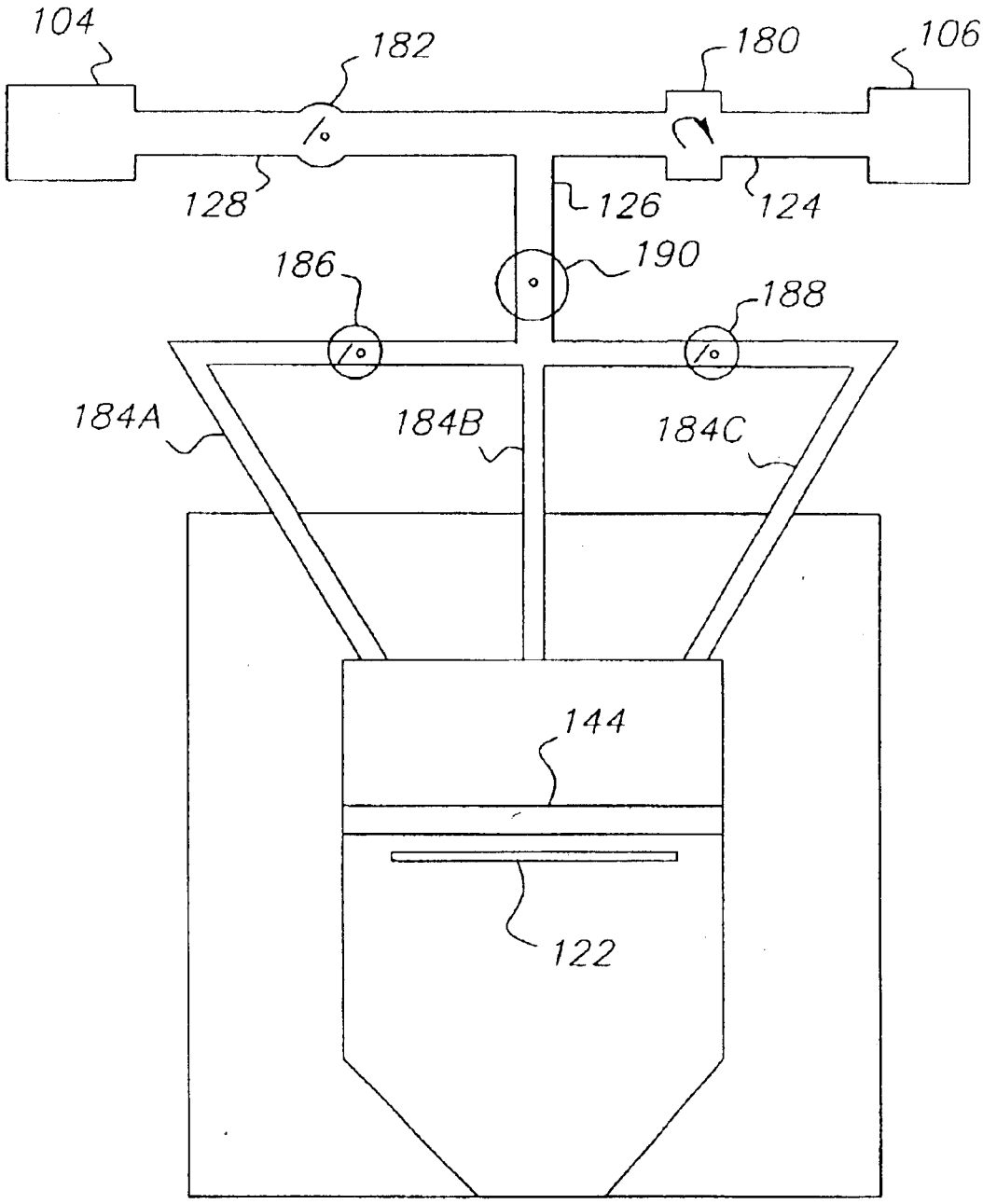
FIG. 8 illustrates one embodiment of a cover and an air/fluid supply system.

FIG. 8 illustrates one embodiment of a gas and fluid delivery system for supply of gas and fluid to the cleaning chamber 120. The embodiment illustrated in FIG. 8 comprises a flow adjustment apparatus 180 along the supply path 124 to control the gas pressure and flow from the gas supply 106, and a control valve 182 located in the supply path 128 from the fluid supply 108. The delivery path 126 divides into three separate paths 184A–C which supply gas and/or fluid to the three inlets 146A–C in the cover 120. It will be appreciated that the delivery system is not limited to three delivery paths or three inlets, and that any desired number or orientation of the delivery paths and inlets can be used. Additional control valves 186, 188 can be positioned along feed lines from delivery path 126 to delivery paths 184A and 184C, such that only the center delivery path 184B remains open when the control valves 186, 188 are closed. A control valve 190 can be positioned in the flow path 126 prior to the flow path division into delivery paths 184A–C, so as to control the flow of gas and/or fluid into the delivery paths 184A–C.

Figure 9:
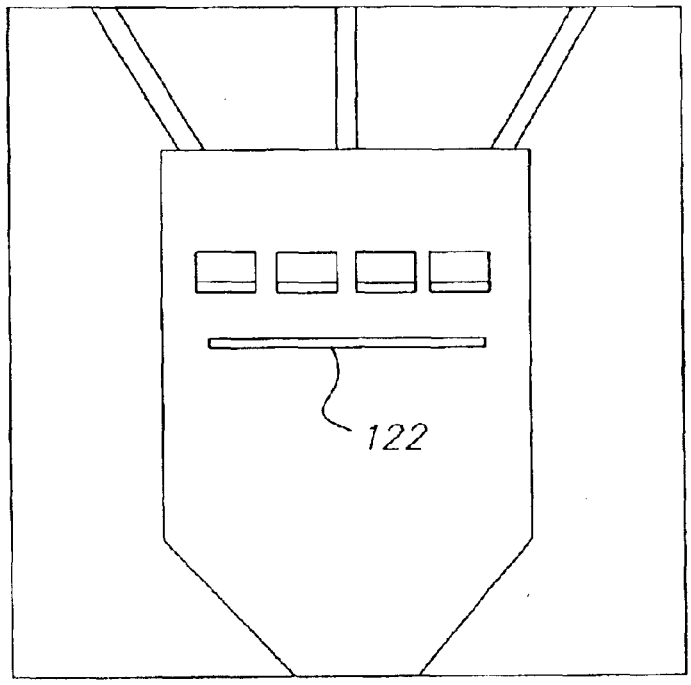
FIG. 9 illustrates another embodiment of a cover.
Figure 10:
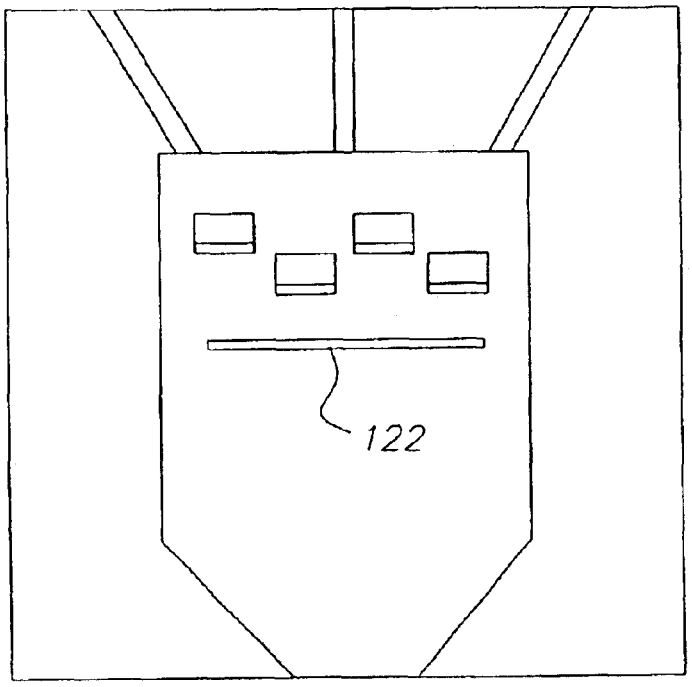
FIG. 10 illustrates another embodiment of a cover.
Figure 11:
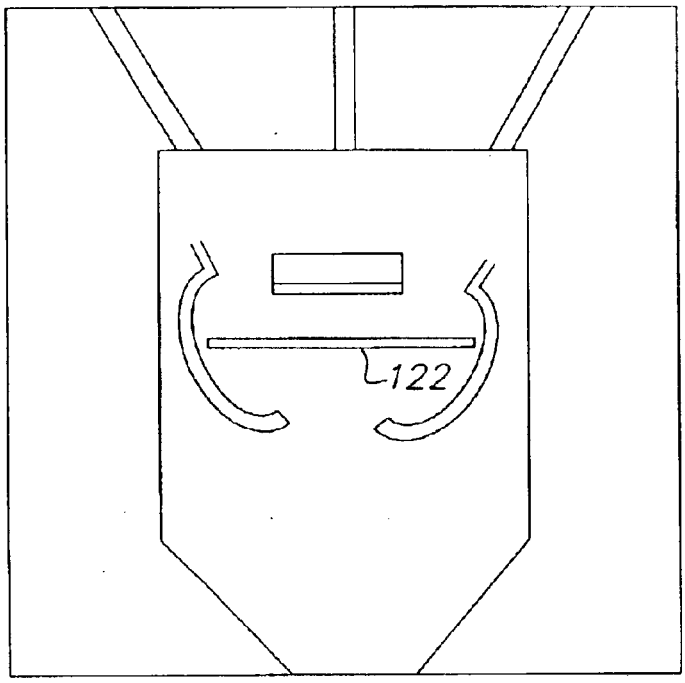
FIG. 11 illustrates another embodiment of a cover.
Figure 12:
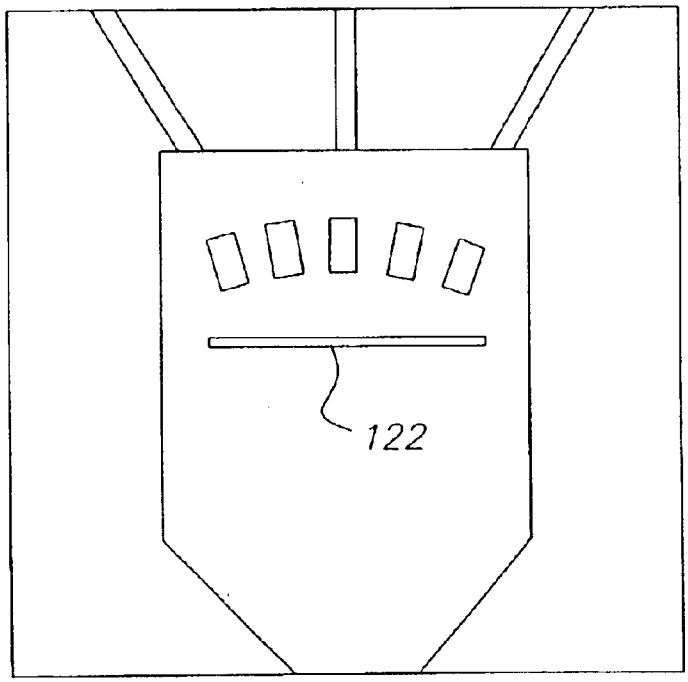
FIG. 12 illustrates another embodiment of a cover.

Multiple cover embodiments are illustrated in FIGS. 9–12, wherein the deflector 144 has different sizes, shapes, and orientations. FIG. 9 illustrates one embodiment of the cover 120 wherein the deflector comprises a plurality of beveled deflector pieces 202A–D positioned in the well 160 substantially parallel to the slit 122 and separated from each other by a predefined distance. FIG. 10 illustrates another embodiment of the cover 120 wherein the deflector pieces are arranged at a variety of different distances from the slit 122. FIG. 11 illustrates a crown shaped deflector in the cover 120, and FIG. 12 illustrates a swirl shaped deflector. It will be appreciated by those skilled in the technology that the deflector structures are not limited to those shown or described herein, and that a plurality of orientations, shapes, and sizes can be implemented for the deflector.

Although a cleaning system and method is shown and described as implemented in a printer using air flow to direct a continuous stream of ink droplets, the systems and method described herein are not limited to such a printing system. The systems and methods described herein may be implemented in printing systems wherein, for example, electrostatic charge is used to direct ink droplets, or alternate configurations of air flow deflection of ink droplets are used. In such environments, the systems and methods of the described invention may be modified so as to effectively perform their intended functions.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

The invention has been described in detail with particular reference to certain preferred embodiments thereof, but it will be understood that variations and modifications can be effected within the spirit and scope of the invention.

What is claimed is:

1. A print system, comprising:

a print head, configured to output a stream of ink from a plurality of nozzles;

a cleaning chamber substantially around an ink ejection area of said plurality of nozzles, wherein said cleaning chamber has an outlet for said stream of ink, said outlet being substantially aligned with said plurality of nozzles;

a pressurized gas source coupled to said cleaning chamber, whereby said gas is routable through said cleaning chamber at a flow rate sufficient to remove debris and excess ink from a region of said print head; and a deflector positioned on a wall of said chamber so as to deflect said gas to increase an angle of incidence at which gas flow is directed at said plurality of nozzles.

2. The print system of claim 1, further comprising a fluid source coupled to said cleaning chamber.

3. The print system of claim 2, further comprising a deflector positioned on a wall of said cleaning chamber and configured to deflect fluid from said fluid source so as to effectively cover an area of said plurality of nozzles, wherein said gas routed through said cleaning chamber also removes said fluid.

4. The print system of claim 1, wherein said gas is air.

5. The print system of claim 1, wherein said gas is nitrogen.

6. The print system of claim 1, further comprising a negative pressure source coupled to one end of said cleaning chamber.

7. A method of removing unwanted particles from one or more print head nozzles, comprising forcing a blast of air into a chamber substantially surrounding said nozzle at a flow rate sufficient to remove unwanted particles from said print head nozzle; and deflecting said air in said chamber at an angle toward said nozzle so as to increase an angle of incidence at which said air is directed at said nozzle.

8. The method of claim 7, further comprising routing a fluid through said chamber so as to change surface properties of said unwanted particles.

9. The method of claim 8, further comprising deflecting said fluid in said chamber so as to effectively cover a substantial area of said nozzle for removal of unwanted particles.

10. The method of claim 9, further comprising deflecting said air routed Through said chamber so as to increase an angle of incidence of a direction of said air as it contacts said nozzles and an area surrounding said nozzles.

11. The method of claim 10, further comprising routing a fluid through said chamber.

12. The method of claim 11, further comprising catching a portion of said fluid in said chamber prior to contact with said nozzles, deflecting said fluid with said air such that an effective area of said plurality of nozzles is substantially covered with said fluid, and removing said fluid with said air.

13. A system for removing unwanted particles from one or more print head nozzles, comprising means for forcing a blast of gas at said print head nozzle and a surrounding area; and means for deflecting said gas at an angle toward said nozzle thereby increasing an angle of incidence at which said gas is directed at said nozzle.

14. The system of claim 13, further comprising means for applying a fluid to said nozzle and a surrounding area.

15. The system of claim 14, further comprising means for deflecting said fluid so as to effectively cover a substantial area of said nozzle for removal of unwanted particles.

16. The system of claim 14, wherein said fluid is alcohol.

17. The system of claim 13, wherein said gas is air.

18. The system of claim 13, wherein said gas is nitrogen.

19. The system of claim 13, wherein said means for forcing a blast of gas at said print head nozzle comprises a negative pressure source.

20. A printing system, comprising:

a print head, configured to produce a stream of ink from a plurality of nozzles;

a first flow path positioned proximate to an ink ejection area of said plurality of nozzles, wherein gas is routed through said first flow path at a flow rate sufficient to remove debris and excess ink from said plurality of nozzles and a surrounding area, said first flow path including an opening being substantially aligned with said plurality of nozzles; and a second flow path positioned farther away from said ink ejection area of said plurality of nozzles than said first gas flow path, configured to provide a path for gas flow for deflecting at least portions of said stream of ink.

21. The printing system of claim 20, wherein said first flow path includes a deflector configured to increase an angle of incidence at which said gas contacts said plurality of nozzles and surrounding area.

22. The printing system of claim 20, wherein fluid is routed through said first how path in addition to said gas.

23. The printing system of claim 22, wherein said first flow path includes a deflector configured to increase an angle of incidence at which said fluid and said gas contact said plurality of nozzles and surrounding area.

24. A print system comprising:

a print head, configured to output a stream of ink from a plurality of nozzles;

a cleaning chamber substantially around an ink ejection area of said plurality of nozzles, wherein said cleaning chamber has an outlet for said stream of ink;

a pressurized gas source coupled to said cleaning chamber, whereby said gas is routable through said cleaning chamber at a flow rate sufficient to remove debris, and excess ink from a region of said print head; and a deflector, positioned on a wall of said chamber so as to deflect said gas to increase an angle of incidence at which gas flow is directed at said plurality of nozzles.

25. A print system comprising:

a print head, configured to output a stream of ink from a plurality of nozzles;

a cleaning chamber substantially around an ink ejection area of said plurality of nozzles, wherein said cleaning chamber has an outlet for said stream of ink;

a pressurized gas source coupled to said cleaning chamber, whereby said gas is routable through said cleaning chamber at a flow rate sufficient to remove debris and excess ink from a region of said print head;

a fluid source coupled to said cleaning chamber; and a deflector positioned on a wall of said cleaning chamber and configured to deflect fluid from said fluid source so as to effectively cover an area of said plurality of nozzles, wherein said gas routed through said cleaning chamber also removes said fluid.

26. A method of removing unwanted particles from one or more print head nozzles comprising:

forcing a blast of air into a chamber substantially surrounding said nozzle at a flow rate sufficient to remove unwanted particles from said print head nozzle;

routing a fluid through said chamber so as to change surface properties of said unwanted particles;

deflecting said fluid in said chamber so as to effectively cover a substantial area of said nozzle for removal of unwanted particles;

deflecting said air routed through said chamber so as to increase an angle of incidence of a direction of said air as it contacts said nozzles and an area surrounding said nozzles;

routing a fluid through said chamber; and catching a portion of said fluid in said chamber prior to contact with said nozzles, deflecting said fluid with said air such that an effective area of said plurality of nozzles is substantially covered with said fluid, and removing said fluid with said air.

27. A method of removing unwanted particles from one or more print head nozzles, comprising forcing a blast of air into a chamber substantially surrounding said nozzle at a flow rate sufficient to remove unwanted particles from said print head nozzle;

routing a fluid through said chamber so as to change surface properties of said unwanted particles; and deflecting said fluid in said chamber at an angle toward said nozzle so as to effectively cover a substantial area of said nozzle for removal of unwanted particles.

28. The method of claim 27, further comprising deflecting said air in said chamber at an angle toward said nozzle so as to increase an angle of incidence at which said air is directed at said nozzle.

29. A print system, comprising:

a print head, configured to output a stream of ink from a plurality of nozzles;

a cleaning chamber substantially around an ink ejection area of said plurality of nozzles, wherein said cleaning chamber has an outlet for said stream of ink, said outlet being substantially aligned with said plurality of nozzles;

a pressurized gas source coupled to said cleaning chamber, whereby said gas is routable through said cleaning chamber at a flow rate sufficient to remove debris and excess ink from a region of said print head;

a fluid source coupled to said cleaning chamber; and a deflector positioned on a wall of said cleaning chamber and configured to deflect fluid from said fluid source so as to effectively cover an area of said plurality of nozzles, wherein said gas routed through said cleaning chamber also removes said fluid.

* * * * *